US006832066B2

(12) United States Patent
Watanabe et al.

(10) Patent No.: US 6,832,066 B2
(45) Date of Patent: Dec. 14, 2004

(54) IMAGE FORMING APPARATUS DRIVING CONVEYING MEDIUM OR INTERMEDIATE TRANSFERRING MEDIUM AND CONTROL METHOD THEREFOR

(75) Inventors: Kenji Watanabe, Shizuoka (JP); Shigeru Kameyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/357,209

(22) Filed: Feb. 4, 2003

(65) Prior Publication Data

US 2003/0152404 A1 Aug. 14, 2003

(30) Foreign Application Priority Data

Feb. 8, 2002 (JP) ..... 2002-032265

(51) Int. Cl.[7] ..... G03G 15/01; G03G 15/00

(52) U.S. Cl. ..... 399/299; 303/75

(58) Field of Search ..... 399/299, 302, 399/303, 167, 75, 76, 77, 301; 347/115, 116

(56) References Cited

U.S. PATENT DOCUMENTS 5,240,249 A 8/1993 Czarnecki et al. ..... 271/118
6,477,348 B2 11/2002 Miyamoto et al. ..... 399/299
2003/0002887 A1 * 1/2003 Imaizumi et al. ..... 399/167

FOREIGN PATENT DOCUMENTS

JP 9-114348 A * 5/1997
JP 2002-108169 A * 4/2002
JP 2002-258580 A * 9/2002

* cited by examiner

*Primary Examiner*—William J. Royer
(74) *Attorney, Agent, or Firm*—Fitzpatrick, Cella, Harper & Scinto

(57) ABSTRACT

A color image forming apparatus has an intermediate transferring body or a driven roller speed detector that is driven by a conveying belt; a calculation device for calculating a difference between a target speed and the speed of the intermediate transferring body or of the conveying belt; and a drive controller for employing the speed difference obtained by the calculation device to correct the speed of the intermediate transferring body or of the conveying belt. In a low-speed printing mode, before an actual image is formed on a transfer material conveyed along the conveying belt or on the intermediate transferring body, speed correction is performed at the 1/1-speed and, after the speed correction has been completed, the speed in the low-speed mode is determined, and the speed correction for the intermediate transferring body or the conveying belt is not thereafter performed during the printing.

24 Claims, 4 Drawing Sheets

IMAGE FORMING APPARATUS DRIVING CONVEYING MEDIUM OR INTERMEDIATE TRANSFERRING MEDIUM AND CONTROL METHOD THEREFOR

BACKGROUND OF THE INVENTION

1. Field of the Invention

The present invention relates to an image forming apparatus, such as a copier or a printer, that employs an electrostatic recording system or an electrophotographic recording system, and relates in particular to an image forming apparatus that comprises a speed controller for an intermediate transferring body or a conveying belt, and a control method therefor.

2. Related Background Art

A full color image forming apparatus is well known that comprises multiple image forming parts for forming an image on a photosensitive drum using an electrophotographic process, wherein images formed by these image forming parts are sequentially superimposed and transferred to the same transfer medium, or to an intermediate transferring body, so as to obtain a full color image. When a full color image is formed on an intermediate transferring body, this image is thereafter collectively transferred to the transfer medium (secondary transfer).

For such an image forming apparatus, when the speed changes at which a conveying belt, used to convey either a transfer medium, or an intermediate transferring body is driven, the position whereat an image is superimposed is shifted, and a so-called misregistration occurs. It should be noted that the speed of a conveying belt varies due to an eccentricity of a drive roller that drives the conveying belt or to an uneven belt thickness, and also due to thermal expansion of the drive roller.

Example fluctuations in the speed of a conveying belt are shown in FIG. 3. In this example, a periodical speed variation that is caused by the eccentricity of the drive roller or the uneven thickness of the belt is superimposed with the speed variation caused by temperature. Therefore, the average speed of the conveying belt is gradually changed due to the rise of the temperature inside the image forming apparatus as it is operated and due to the environmental change of the apparatus. That is, as is described above, even when the adjustment is made to remove detected misregistration, the misregistration in the sub-scanning direction that depends on the speed of the conveying belt is increased in proportion to the degree of the temperature change.

As one method whereby the conveying speed or the traveling speed of the intermediate transferring body is stabilized as much as possible to prevent the occurrence of misregistration, there is a technique for controlling a motor that rotates a drive roller for driving a conveying belt, so that, based on the speed of the conveying belt that is detected, a target conveying speed is set. According to this technique, in order to detect the rotational speed at which a driving roller is driven in synchronization with a conveying belt, an optical sensor is employed that generates a pulse signal synchronized with the rotation of the driving roller (outputs a pulse for each revolution).

For the full color image forming apparatus, there is a well known technique that performs image forming by setting the image forming speed and the conveying speed to a low level (1/2-speed or 1/4-speed) in order to satisfactorily fix an image to a sheet other than a regular sheet, such as a thick sheet or an OHT. However, when this conveying belt speed stabilization technique is employed in a low speed mode, the following problems have arisen.

When the speed of the conveying belt or the intermediate transferring body is to be detected in the low-speed mode (1/2-speed, 1/3-speed or 1/4-speed) within the same period as for detection for the 1/1-speed, the total fetched number of pulses that are generated for each revolution of the driven roller is smaller than the number of pulses fetched at the 1/1-speed, and the conveying belt speed would be corrected under the adverse affect of a variance of the pulse intervals. As a result, the belt speed becomes unstable. Accordingly, the belt speed differs between when the misregistration is detected and when the printing is actually performed, and misregistration occurs in the sub-scanning direction. Further, at the sequential printing, the misregistration distance in the sub-scanning direction differs for each printed sheet. In addition, when the number of pulses fetched for each revolution of the driven roller operated at a low speed is to be equaled to that at the 1/1-speed, the first printing period is extended, and the performance of the image forming apparatus is deteriorated.

SUMMARY OF THE INVENTION

To resolve these problems, it is an object of the present invention to provide a color image forming apparatus that can improve the image forming operation by reducing misregistration on an image by precisely performing speed correction for low-speed mode printing and a control method therefor.

Another object of the present invention is to provide an image forming apparatus comprising:

- an image forming apparatus as an image forming means for forming an image;
- a conveying member as conveying means for conveying a transfer medium to which the image is to be transferred;
- a driver as driving means for driving the conveying member at one of multiple speeds, which at least include a standard speed mode and a low speed mode;
- a detector as detecting means for detecting a conveying speed for the conveying member; and
- a controller as control means for controlling a drive condition of the conveying member based on the detection results obtained by the detector,
- wherein the controller employs the conveying speed of the conveying member in the standard speed mode to determine the drive condition of the conveying member in the low speed mode.

A further object of the present invention is to provide an image forming apparatus comprising:

- an image forming apparatus as an image forming means for forming an image;
- an intermediate transferring body to which the image is to be transferred;
- a driver as driving means for driving the intermediate transferring body at one of multiple speeds, which at least include a standard speed mode and a low speed mode;
- a detector as detecting means for detecting a traveling speed for the intermediate transferring body; and
- a controller as control means for controlling a drive condition for the intermediate transferring body based on the traveling speed detected by the detector, wherein the controller employs the traveling speed detected in the standard speed mode for the intermediate transferring body to determine the drive condition for the intermediate transferring body in the low speed mode.

A still further object of the present invention is to provide a control method, for an image forming apparatus that drives a conveying member as conveying means for conveying, in one of multiple speed modes, including at least a standard speed mode and a low speed mode, a transfer medium to which a formed image is to be transferred, comprising:

a detection step of detecting, in the standard speed mode, a conveying speed for the conveying member; and a control step of employing the conveying speed detected in the detection step to control a drive condition for the conveying member, wherein, in the control step, based on the conveying speed detected in the standard speed mode for the conveying member, a drive condition in the low speed mode is determined for the conveying member.

A yet further object of the present invention is to provide a control method, for an image forming apparatus that is capable of driving an intermediate transferring body, to which a formed image is to be transferred, in one of multiple speed modes, including at least a standard speed mode and a low speed mode, comprising:

a detection step of detecting a traveling speed for the intermediate transferring body; and a control step of employing the traveling speed detected in the detection step to control a drive condition for the intermediate transferring body, wherein, in the control step, based on the traveling speed detected in the standard speed mode for the intermediate transferring body, a drive condition in the low speed mode is determined for the intermediate transferring body.

Other objects, configurations and effects of the present invention will become obvious during the course of the following detailed description, given while referring to the accompanying drawings.

DETAILED DESCRIPTION OF THE PREFERRED EMBODIMENT

A color image forming apparatus according to the preferred embodiment of the present invention will now be described.

Figure 2:
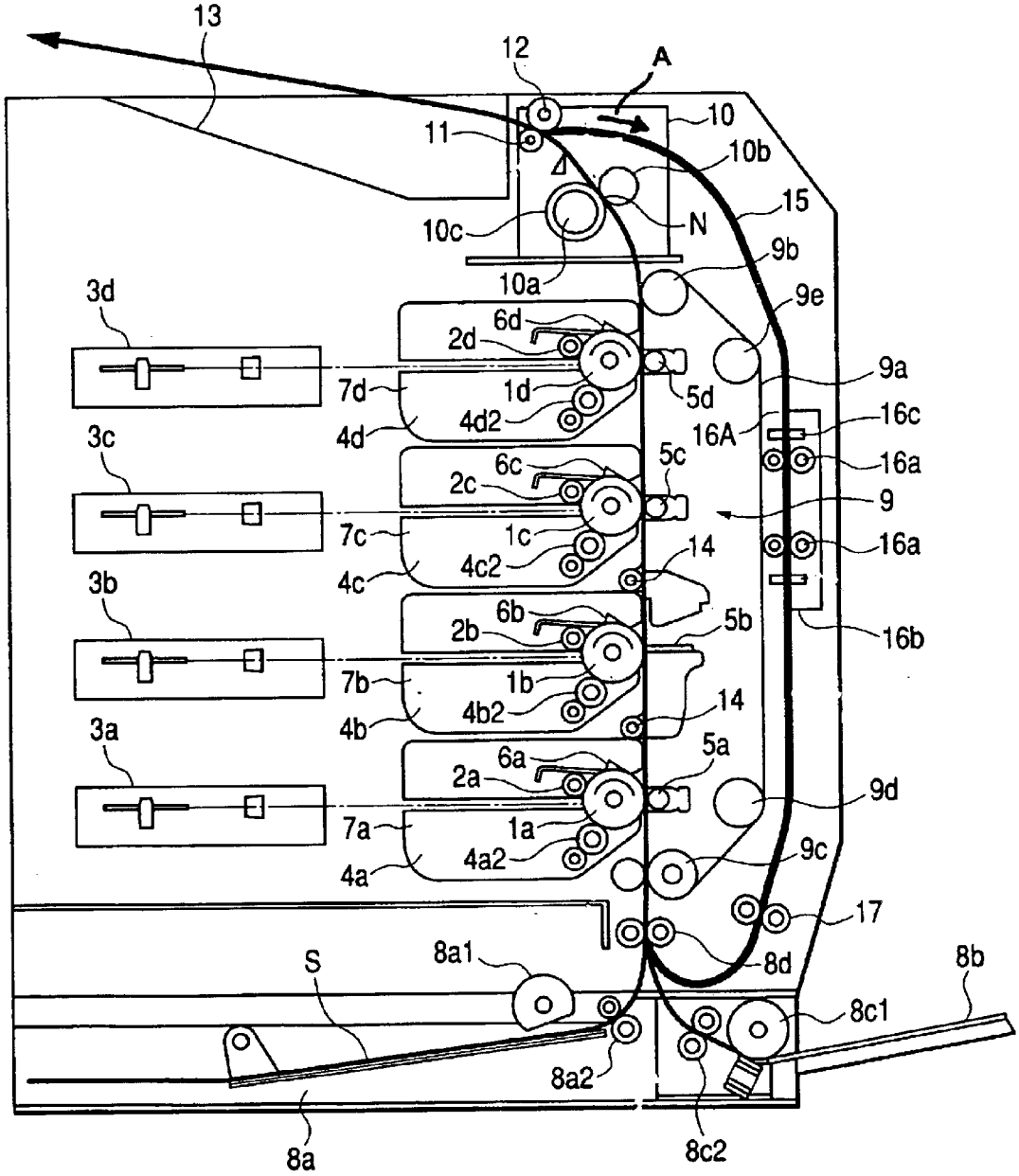
FIG. 2 is a cross-sectional view of the essential configuration of the color image forming apparatus.
Figure 3:
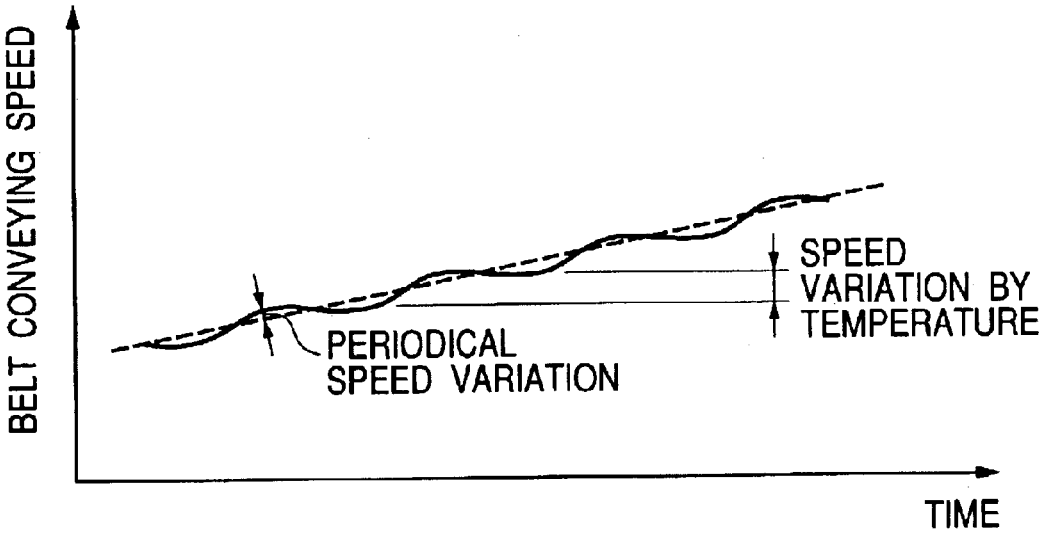
FIG. 3 is a graph for explaining changes in the speed of a conveying belt.

FIG. 2 is a schematic cross-sectional view of a full color image forming apparatus, according to this embodiment, that includes four image bearing bodies.

The full color image forming apparatus in FIG. 2 comprises four photosensitive drums 1 (1*a*, 1*b*, 1*c* and 1*d*). And to constitute image forming means, respectively arranged around the photosensitive drums 1 are charging means 2 (2*a*, 2*b*, 2*c* and 2*d*) for uniformly charging the surfaces of the photosensitive drums 1, exposure means (laser scanners) 3 (3*a*, 3*b*, 3*c* and 3*d*) for the emission, based on image data, of laser beams to form electrostatic latent images on the photosensitive drums 1, developing means 4 (4*a*, 4*b*, 4*c* and 4*d*) for attaching toner to the electrostatic latent images to provide visual toner images, transfer means (transfer rollers) 5 (5*a*, 5*b*, 5*c* and 5*d*) for transferring the toner images from the photosensitive drums 1 to a transfer material, and cleaning means 6 (6*a*, 6*b*, 6*c* and 6*d*) for removing toner still remaining on the photosensitive drums 1 from the surfaces of the photosensitive drums 1 after the toner images have been transferred.

The photosensitive drums 1, the charging means 2, the developing means 4 and the cleaning means 6 for removing toner are integrally formed as process cartridges 7 (7*a*, 7*b*, 7*c* and 7*d*). A transfer material S, which is fed from a paper feeding parts 8*a* by feed roller 8*a*1 and thru roller pairs 8*a*2, 8*d* and 9*c*, is conveyed by conveying means 9 including a conveying belt 9*a* extending around rollers 9*b*, 9*c*, 9*d* and 9*e*, to the image forming means, whereat the individual color toner images are sequentially transferred to the transfer material S to form a color image thereon. The color image is fixed to the transfer material S by fixing means 10, and the transfer material S is thereafter discharged to a discharge part 13 by discharge rollers 11 and 12. For double-sided printing, however, before the transfer material S to which an image has been fixed by the fixing means 10 is discharged by the discharge rollers 11 and 12, the rotational direction of the discharge rollers 11 and 12 is reversed and the transfer material S is conveyed (in the direction indicated by an arrow A) to a double-sided printing conveying path 15. The transfer material S conveyed to the double-sided conveying path 15 is passed through a conveying guide 16*b*, constituted by oblique feed rollers 16*a* and provided at the front of the main body, and conveyed downward, perpendicularly, to U turn rollers 17. The transfer material S is then conveyed to the image forming means by the U turn rollers 17 and resist rollers 8*d*.

Transfer material may also be inserted from tray 8*b* by feed roller 8*d* and convey rollers 8*c*2. The operation of the color image forming means will now be described.

In the case that a Personal Computer (PC) transmits data to be printed, when image forming is terminated according to the type of printer engine and the printer is ready to print, a transfer material S is fed from a transfer material cassette 8*b* to a conveying belt 9*a*, and is conveyed by the conveying belt 9*a* to each of the image forming means for each of the colors. At the same timing whereat the transfer material S is conveyed by the conveying belt 9*a*, image signals for each of the colors are transmitted to the laser scanners 3*a* to 3*d*, electrostatic latent images are formed on the photosensitive drums 1*a* to 1*d* and are developed, using toners, by the developing devices 4*a* to 4*d*, which include developing rollers 4*a*2, 4*b*2, 4*c*2 and 4*d*2, and the obtained toner images are transferred to the transfer material S by the transfer means 5*a* to 5*d*. In FIG. 2, C, Y, M and K images are formed and transferred, in the named order, and thereafter, the transfer material S is separated from the conveying belt 9*a*, the toner image is thermally fixed to the transfer material S by the fixing means 10 as it passes through the nip N between fixing roller 10*c* and pressure roller 10*b*, fixing roller 10*c* having therein heater 10*a*, and the resultant transfer material S is discharged externally.

As is described above, to provide a full color image, the color image forming apparatus superimposes on the transfer material S, which is conveyed by the conveying belt 9*a,* four single color images, in yellow, magenta, cyan and black. Therefore, in the case that the positions for drawing the four color images in the sub-scanning direction do not match, an image forming problem, so-called misregistration, occurs.

Further, other factors that cause misregistration are drawing position shifts in the main scanning direction (perpendicular to the belt conveying direction) and variances in the main scanning line widths.

To correct misregistration in the sub-scanning direction and in the main scanning direction, paired optical sensors are provided, one on each side, downstream, of the conveying belt 9*a.* The optical sensors detect misregistration distances by using misregistration detection patterns formed for the individual colors, and the drawing positions are adjusted based on the detected misregistration distances.

Figure 4:
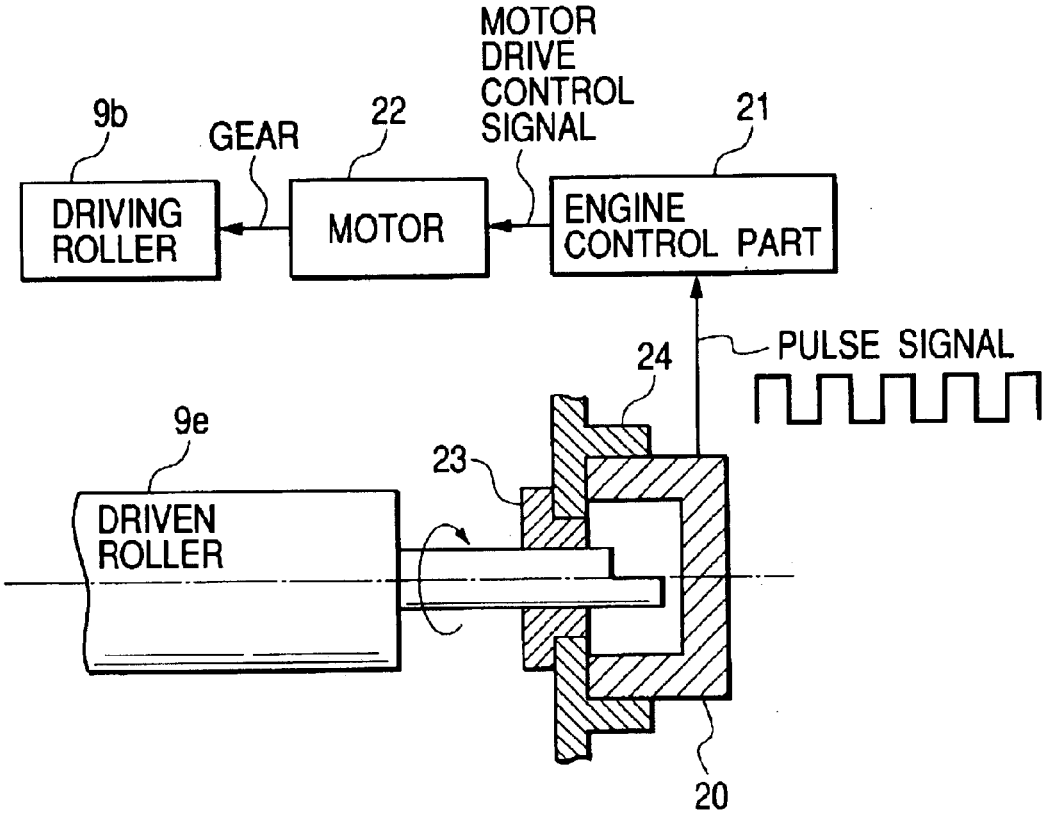
FIG. 4 is an explanatory diagram showing a speed detector for the conveying belt, and a controller.

FIG. 4 is a diagram showing the section whereat the speed of the conveying belt 9*a* is detected, and the structure for stabilizing the motor speed based on the detected speed. In FIG. 4, the detection section includes a driven roller 9*e,* which is rotated while interacting with the conveying belt 9*a* (or an intermediate transferring body); a bearing 23 for the driven roller 9*e;* an optical sensor 20; and a member 24 for supporting the optical sensor 20 and the bearing 23. The distal end of the driven roller 9*e* is cut away to form a D shaped open portion, and the light axis of the optical sensor 20 is shifted slightly relative to the axis of the driven roller 9*e*. Each time the driven roller 9*e* is rotated once by the conveying belt 9*a* (see FIG. 2), a beam emitted by the optical sensor 20 passes through the distal end of the driven roller 9*e,* through the D shaped open portion, and a single pulse signal is generated. In this manner, in synchronization with the rotation of the driven roller 9*e* and consonant with the revolution speed, the pulse signal is cyclically generated. Then, based on the pulse signal cycle, an engine control part 21 computes the operation and outputs, to a motor 22, a drive control signal for driving the conveying belt 9*a* at a predetermined speed. In this manner, a constant conveying speed is maintained for the conveying belt 9*a*. In addition to controlling the motor 22, the engine control part 21 also controls various other parts required for the electrophotographic process.

Figure 1:
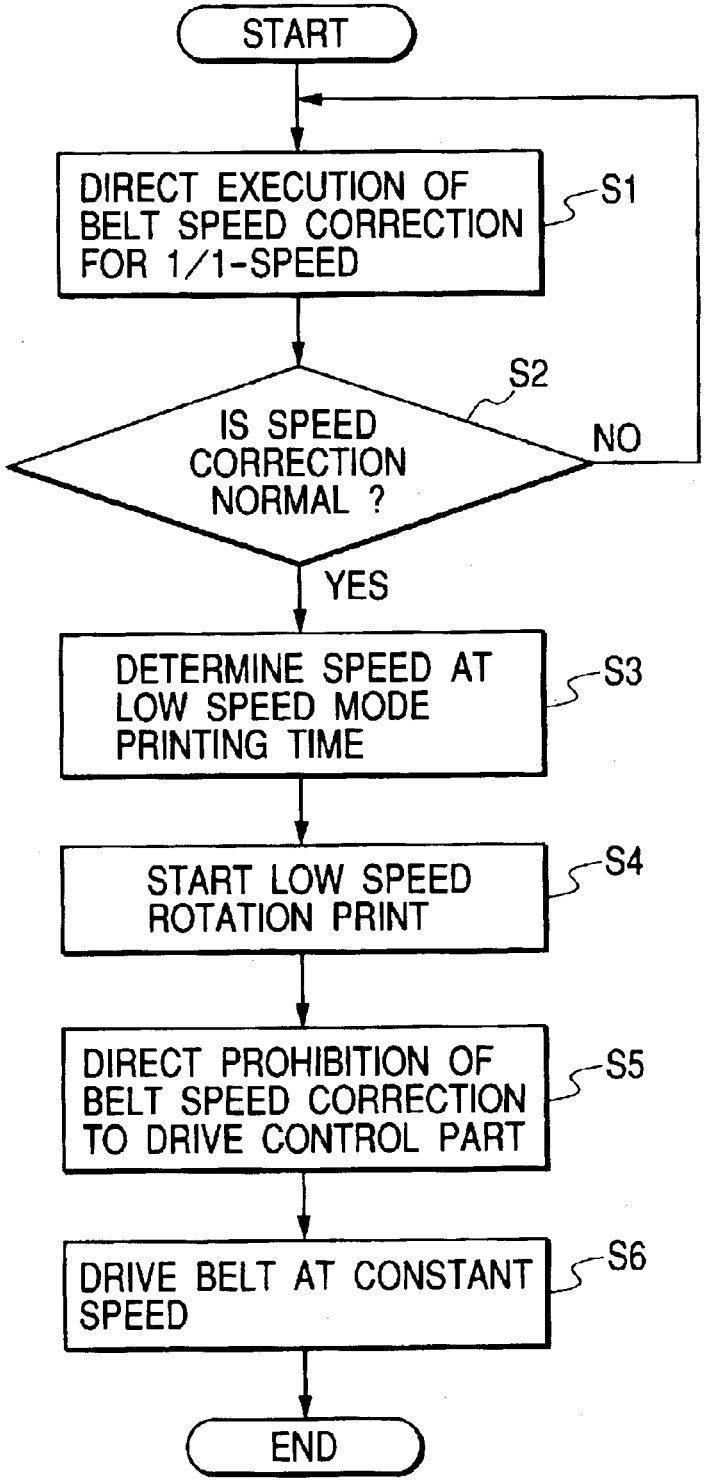
FIG. 1 is a flowchart showing a printing sequence performed in a low speed mode by a color image forming apparatus according to the present invention.

The printing sequence in a low speed mode will now be described while referring to FIG. 1.

A printer control part instructs a drive control part to perform a speed correction for the intermediate transferring body or the conveying belt 9*a* driven at the 1/1-speed (step S1). It is judged whether the conveying speed correction is normally performed and whether the corrected speed matches a target speed (step S2). In the case that the decision is YES, i.e., in the case that the correction is normally performed, the speed of the intermediate transferring body or the conveying belt 9*a* is determined for printing performed in the low speed mode (step S3). At this time, for the 1/2-speed, half of the motor revolutions for the speed correction at the 1/1-speed is employed, and when the number of revolutions is not evenly divisible, a value rounded to a fraction is employed. The same calculation is performed for the 1/3-speed and the 1/4-speed.

After the speed in the low speed mode is determined, printing at low-speed revolutions is performed at the determined speed (step S4). Thereafter, the printer control part issues a correction prohibition instruction to the drive control part so as to maintain the conveying belt speed (step S5). During the printing in the low speed mode, the intermediate transferring body or the conveying belt 9*a* is driven at constant motor revolutions (step S6).

In this embodiment, the ratio of the outer diameter of a driving roller 9*b* to the outer diameter of the driven roller 9*e* is 3:2, so in the case that the driving roller 9*b* performs two revolutions, the driven roller 9*e* performs three revolutions. This is to cancel the measurement error due to the eccentricities of the driving roller 9*b* and the driven roller 9*e*. A three revolution cycle for the driven roller 9*e* is employed as one unit, and the speed of the conveying belt 9*a* is controlled based on this unit.

Using the speed detection for the 1/1-speed printing as an example, first, the conveying belt 9*a* is driven by a motor (not shown), and after three seconds have elapsed, the pulse interval for the driven roller 9*e* is read. When three pulses have been fetched, the intervals for the three pulses are compared with a predetermined pulse interval, and the motor is controlled to match these intervals. This process is repeated five times to change the speed of the conveying belt 9*a* so it is near the target value. Finally, the intervals for nine pulses are compared with the predetermined pulse interval, and if a difference in the intervals falls within a predetermined value, the printing is executed. Generally, the conveying speed almost reaches the target value by repeating the speed control process five times, and the final comparison for the intervals for nine pulses is performed in order to average an error that occurs due to the uneven thickness of the conveying belt 9*a*. Further, in the above process sequence, 24 revolutions of the driven roller 9*e* are required, and for this, about 15 seconds are required.

As is described in the conventional examples, for printing in the low speed mode, speed detection is performed at a low speed. Therefore, when the speed control is performed within the same period of time as for the 1/1-speed printing, the number of pulses fetched for the driven roller 9*e* is reduced compared with the 1/1-speed. As a result, the times for the speed control processes before the printing is begun is reduced (three times for the 1/2-speed and two times for the 1/3-speed and the 1/4-speed). Thus, since the printing is performed even though the conveying speed has not yet reached the target value, misregistration occurs due to the difference in the conveying belt speed. Further, when the number of speed detections is to be equal to that for the 1/1-speed printing, the required time is doubled for the 1/2-speed, tripled for the 1/3-speed, or quadrupled for the 1/4-speed, so that the first printing period is considerably extended.

To resolve this problem, in this embodiment, as is described above, first the speed control is performed at the 1/1-speed for the printing in the low speed mode, the number of motor revolutions in the low speed mode is determined based on the control value, and thereafter, the conveying belt 9*a* is driven at constant motor revolutions during the printing.

As previously described, during continuous paper feeding by the constant motor revolutions at the 1/1-speed, misregistration occurs due to the conveying belt speed and due to the rise in the temperature inside the apparatus. However, even when the continuous paper feeding of 100 sheets is performed in all the modes for the 1/2-speed, the 1/3-speed and the 1/4-speed, the thermal expansion of the driving roller 9*b* is not detected, and misregistration does not occur due to the conveying belt speed during the printing at the constant motor revolutions.

Figure 5:
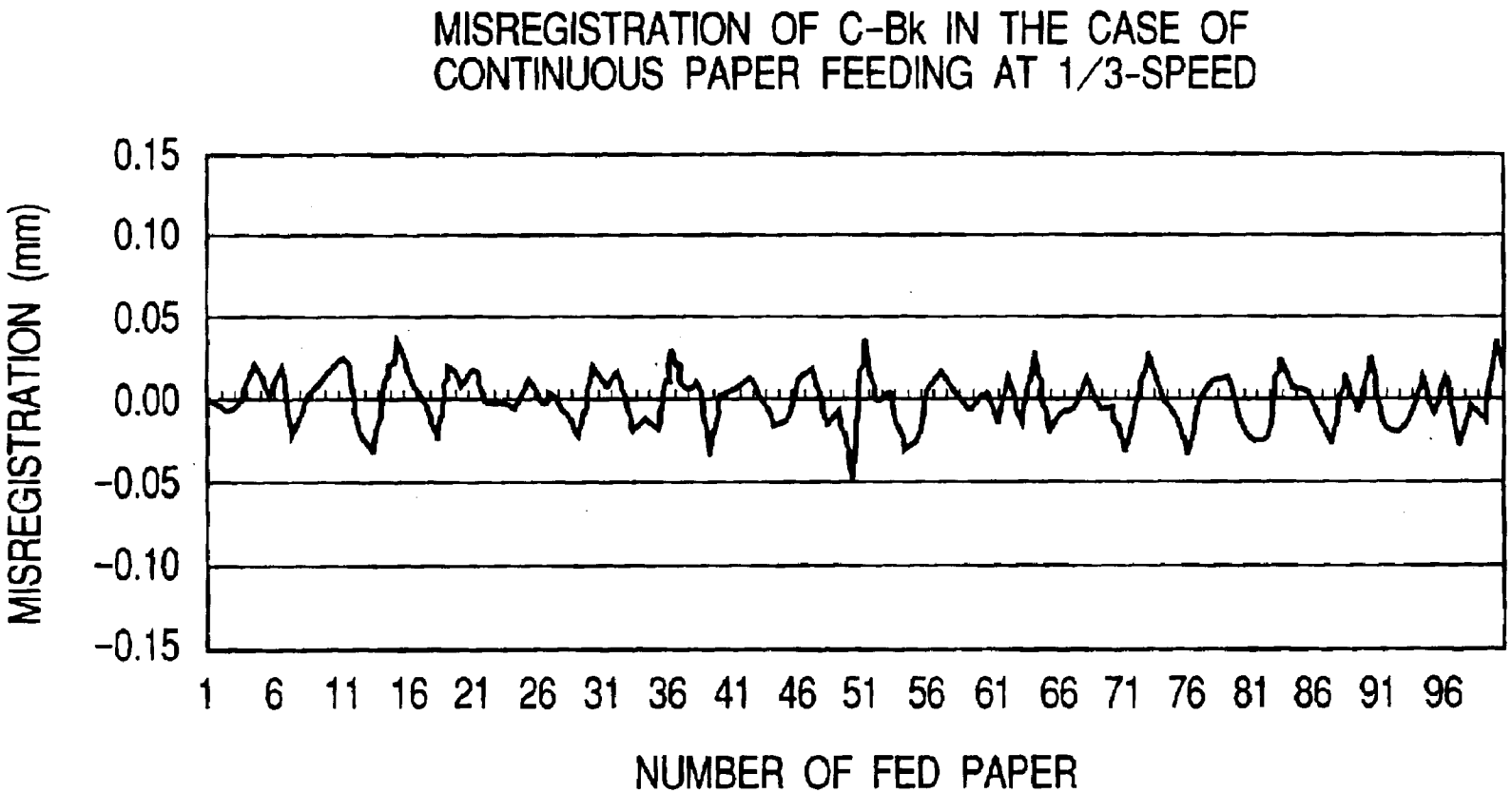
FIG. 5 is a graph showing misregistration changes during continuous paper feeding at 1/3-speed.

FIG. 5 is a graph showing the changes in the misregistration of C (cyan) relative to Bk (black), as the result of the continuous paper feeding of 100 sheets at the 1/3-speed. The horizontal axis represents the number of sheets continuously fed, and the vertical axis represents a misregistration distance (mm). Since the pitch between C-Bk drums is the longest, this portion is affected the most by the difference in the conveying belt speed.

As is apparent from the graph, for the colors, the misregistration is not changed even when the number of sheets continuously fed is increased. Through the measurements, it is found that the rotation cycle of the driven roller 9*e* does not differ at the initial stage and the last stage. It is therefore determined that the driving roller 9*b* has not thermally expanded following the continuous paper feeding of 100 sheets. In this embodiment, for printing at the 1/2-speed, the 1/3-speed or the 1/4-speed, the above results are established, since transfer materials are be supplied through the multi-paper supply port and only a maximum of 100 sheets can be mounted. Further, for continuous paper feeding of more than 100 sheets, the speed detection at the 1/1-speed need only be performed every 100 sheets to establish the above results.

According to this embodiment, since speed correction is performed for printing in the low speed mode, misregistration of images can be reduced and the image forming performance can be improved.

In this embodiment, an explanation has been given for an image forming apparatus that sequentially transfers images in individual colors to the transfer material S conveyed by the conveying belt 9*a*. The present invention can also be applied for an image forming apparatus that transfers images in individual colors to an intermediate transferring body (primary transfer), and thereafter collectively transfers the image on the intermediate transferring body to a transfer material (secondary transfer). In this case, of course, the traveling speed of the intermediate transferring body is established, and to the extent possible, misregistration can be prevented The preferred embodiment of the present invention has been explained. However, the present invention is not limited to this embodiment, and it is obvious that the invention can be variously modified without departing from the scope of the invention.

What is claimed is:

1. An image forming apparatus comprising:

an image forming unit adapted to form an image;

a conveying medium adapted to convey a transfer medium to which the image formed by the image forming unit is transferred;

a driving unit adapted to drive the conveying medium at a multiple speed mode, a detector adapted to detect a conveying speed of the conveying medium; and a controller adapted to control a driving condition of the driving unit based on a detection result obtained by the detector, wherein the controller determines, based on a detection result at a first speed mode among the multiple speed mode, a driving condition for a second speed mode which is different from the first speed mode.

2. An image forming apparatus according to claim 1, wherein the driving unit includes a driving roller for driving the conveying medium, and a motor for rotating the driving roller.

3. An image forming apparatus according to claim 1, wherein the detector includes a sensor for outputting a pulse signal in synchronization with the rotation of a roller.

4. An image forming apparatus according to claim 3, wherein the detector includes a determination unit adapted to obtain a predetermined number of pulse signals output from the sensor, and to measure intervals for the pulses to detect the conveying speed of the conveying medium.

5. An image forming apparatus according to claim 4, wherein the controller repeats a control process based on the driving condition determined by the determination unit, by a predetermined number of times.

6. An image forming apparatus according to claim 3, wherein the roller is a driven roller which is rotated in synchronization with the conveying of the conveying medium.

7. An image forming apparatus according to claim 1, wherein the detector is an optical sensor.

8. An image forming apparatus according to claim 1, wherein after the driving condition is determined, the driving condition is maintained during image forming in the second speed mode.

9. An image forming apparatus according to claim 1, wherein the multiple speed mode comprises a normal speed mode and a low speed mode which drives at a lower speed than the normal speed mode, and wherein the controller determines a driving condition for the low speed mode based on a detection result at the normal speed mode.

10. An image forming apparatus according to claim 9, a plurality of the image forming means, wherein a process speed at the low speed mode is half of a process speed at the normal speed mode.

11. An image forming apparatus according to claim 1, wherein said apparatus comprises a plurality of image forming units, and images formed by each of the image forming units are transferred to a common transfer medium conveyed by the conveying medium.

12. An image forming apparatus comprising:

an image forming unit adapted to form an image;

an intermediate transferring medium to which an image formed by the image forming unit is transferred;

a driving unit adapted to drive the intermediate transferring medium at a multiple speed mode;

a detector adapted to detect a traveling speed of the intermediate transferring medium; and a controller adapted to control a driving condition of the driving unit based on a detection result obtained by the detector, wherein the controller determines, based on a detection result at a first speed mode among the multiple speed mode, a driving condition for a second speed mode which is different from the first speed mode.

13. An image forming apparatus according to claim 12, wherein the driving unit includes a driving roller for driving the intermediate transferring medium, and a motor for rotating the driving roller.

14. An image forming apparatus according to claim 12, wherein the detector includes a sensor for outputting a pulse signal in synchronization with the rotation of a roller.

15. An image forming apparatus according to claim 14, wherein the detector includes a determination unit adapted to obtain a predetermined number of the pulse signals output from the sensor, and to measure intervals for the pulses to detect the traveling speed of the intermediate transferring medium.

16. An image forming apparatus according to claim 15, wherein the controller repeats a control process based on the driving condition determined by the determination unit, by a predetermined number of times.

17. An image forming apparatus according to claim 14, wherein the roller is a driven roller which is rotated in synchronization with the traveling of the conveying medium.

18. An image forming apparatus according to claim 12, wherein the detector is an optical sensor.

19. An image forming apparatus according to claim 12, wherein after the driving condition is determined, the driving condition is maintained during image forming in the second speed mode.

20. An image forming apparatus according to claim 12, wherein the multiple speed mode comprises a normal speed mode and a low speed mode which is lower speed than the normal speed mode, and wherein the controller determines a driving condition for the low speed based on the detection result at the normal speed mode.

21. An image forming apparatus according to claim 20, wherein the process speed at the low speed mode is half of a process speed at the normal speed mode.

22. An image forming apparatus according to claim 12, wherein said apparatus comprises a plurality of the image forming units, and images formed by image forming units are transferred to the intermediate transferring medium, and the images on the intermediate transferring medium transferred to a transfer medium.

23. A control method for an image forming apparatus which drives a conveying medium for conveying a transfer medium to which an image formed by an image forming unit is transferred at a multiple speed mode, the method comprising:

a detection step of detecting a conveying speed of the conveying medium; and a control step of controlling a driving condition of the conveying medium based on a detection result in the detection step, wherein in the control step, based on a detection result at a first speed mode among the multiple speed mode, a driving condition for a second speed mode which is different from the first speed mode is determined.

24. A control method for an image forming apparatus which drives an intermediate transferring medium to which an image formed by an image forming unit is transferred at a multiple speed mode, the method comprising:

a detection step of detecting a traveling speed of the intermediate transferring medium; and a control step of controlling a driving condition of a conveying medium based on detection results in the detection step, wherein in the control step, based on a detection result at a first speed mode among the multiple speed mode, a driving condition for a second speed mode which is different from the first speed mode is determined.

* * * * *

UNITED STATES PATENT AND TRADEMARK OFFICE

CERTIFICATE OF CORRECTION

PATENT NO. : 6,832,066 B2
DATED : December 14, 2004
INVENTOR(S) : Kenji Watanabe et al.

It is certified that error appears in the above-identified patent and that said Letters Patent is hereby corrected as shown below:

Title page,
Item [56], References Cited, U.S. PATENT DOCUMENTS, "5,240,249 A 8/1993 Czarnecki et al." should read -- 5,240,242 A 8/1993 Ando et al. --.

Column 4,
Line 19, "thru" should read -- through --.
Line 43, "that" should read -- where --.

Column 7,
Line 39, "variously modified" should read -- modified in various ways --.
Line 49, "mode," should read -- mode; --.
Line 57, "a multiple speed mode, should read -- multiple speed modes, --.

Column 8,
Lines 29-30, "a plurality of the image forming means," should be deleted.
Line 51, "a multiple speed mode," should read -- multiple speed modes, --.

Column 10,
Lines 13 and 26, "a multiple speed mode," should read -- multiple speed modes, --.

Signed and Sealed this

Twenty-sixth Day of April, 2005

JON W. DUDAS
*Director of the United States Patent and Trademark Office*